US012507818B2

(12) United States Patent
Jacob et al.

(10) Patent No.: US 12,507,818 B2
(45) Date of Patent: Dec. 30, 2025

(54) NO-TOUCH STRAW

(71) Applicant: Brumate, Inc., Denver, CO (US)

(72) Inventors: Dylan M. Jacob, Denver, CO (US); Jordan Westerberg, Denver, CO (US)

(73) Assignee: Brumate, Inc., Denver, CO (US)

( * ) Notice: Subject to any disclaimer, the term of this patent is extended or adjusted under 35 U.S.C. 154(b) by 54 days.

(21) Appl. No.: 18/529,632

(22) Filed: Dec. 5, 2023

(65) Prior Publication Data

US 2025/0176742 A1 Jun. 5, 2025

(51) Int. Cl.
*A47G 19/22* (2006.01)
*B65D 47/06* (2006.01)

(52) U.S. Cl.
CPC ..... *A47G 19/2272* (2013.01); *B65D 47/065* (2013.01); *B65D 2543/00046* (2013.01)

(58) Field of Classification Search
CPC ..... A47G 19/2266; A47G 19/2272; A47G 19/2222; B65D 47/065; B65D 47/06; B65D 47/04
USPC ..... 215/388, 389, 387, 229, 228; 220/708, 220/705, 212; 222/556
See application file for complete search history.

(56) References Cited

U.S. PATENT DOCUMENTS 5,242,079 A 9/1993 Stephens et al.
5,339,982 A * 8/1994 Tardie ..... A47G 19/2266 215/229
5,884,793 A * 3/1999 Wang ..... B65D 47/0838 220/255
7,516,862 B2 4/2009 McDonough
7,950,541 B2 5/2011 Holcomb et al.
8,636,166 B2 1/2014 Lane
11,213,146 B1 1/2022 Sletten
12,096,878 B1 9/2024 Lin
2005/0040175 A1* 2/2005 Stephens ..... B65D 47/061 220/709
2011/0132907 A1 6/2011 Hajichristou et al.
2013/0214012 A1 8/2013 Pils et al.
2016/0200486 A1 7/2016 Meyers et al.
2017/0341828 A1 11/2017 Balkus
2018/0050844 A1 2/2018 Hirst et al.
2024/0000251 A1* 1/2024 Kim ..... A47G 19/2266

FOREIGN PATENT DOCUMENTS

CN 203997451 U 12/2014
CN 216187519 U 4/2022
CN 218528398 U 2/2023
(Continued)

OTHER PUBLICATIONS

Facebook : "BrüMate VIP Group", Hey BruCrew. Group created on May 15, 2018. 3 pages.

(Continued)

*Primary Examiner* — Robert J Hicks
(74) *Attorney, Agent, or Firm* — Shook, Hardy & Bacon L.L.P.

(57) ABSTRACT

Aspects described herein generally relate to beverage systems. More specifically, they pertain to beverage systems featuring a lid structure that incorporates a no-touch straw mechanism. The no-touch straw mechanism allows users to transition a spout portion of the lid structure between a dispensing state and a stored state without physically contacting the spout portion of the lid structure.

20 Claims, 15 Drawing Sheets

(56) References Cited

FOREIGN PATENT DOCUMENTS

| | | | |
|---|---|---|---|
| CN | 116807214 | A | 9/2023 |
| CN | 116831427 | A | 10/2023 |
| CN | 219813757 | U | 10/2023 |
| CN | 220403714 | U | 1/2024 |
| FR | 2966132 | A3 | 4/2012 |
| IT | 201900019226 | A1 | 4/2021 |
| TW | 202108052 | A | 3/2021 |
| WO | 2021/014593 | A1 | 1/2021 |
| WO | 2022/101249 | A1 | 5/2022 |

OTHER PUBLICATIONS

Ex Parte Quayle Action received for U.S. Appl. No. 18/529,703, mailed on Jul. 23, 2025, 6 pages.
Final Office Action received for U.S. Appl. No. 19/079,102, mailed on May 30, 2025, 13 pages.
Office action received for GB Patent Application No. 2410921.7, mailed on Apr. 4, 2025, 4 pages.
Screen Captures from Amazon, "Polar Camel Tumbler Lid Replacement—Magnetic Lid", Available online at: <https://www.amazon.com/Polar-Camel-Tumbler-Lid Replacement/dp/B09B4R7SLC/?th=1>, Jun. 10, 2021, 1 page.

* cited by examiner

NO-TOUCH STRAW

FIELD

Aspects provided herein relate to portable drinkware, such as insulated travel mugs, tumblers, shaker cups, and the like.

BACKGROUND

Portable drinkware can include a variety of containers suitable for on-the-go consumption. Such drinkware can include insulated cups, non-insulated cups, double wall cups, or any other suitable beverage container that includes a fitted lid to prevent accidental spills. The lids can be simple screw-on lids or press-on lids, and may not always be leak-proof. Drinkware equipped with a straw can also require manual manipulation, which may pose sanitary concerns.

SUMMARY

At a high level, a beverage container may include a lid structure coupled to a base structure to define an interior volume for holding and/or dispensing a beverage held within the beverage container. The base structure may be a cup shaped container that may optionally be insulating to keep drinks cold/hot for extended periods of time (e.g., between 4 hours and 48 hours). The lid structure may have a spout portion or a straw mechanism for dispensing the contents of the beverage container when the lid structure and the base structure are engaged with one another. In order to provide a leak-proof beverage container, the straw mechanism is able to transition between a closed state (i.e., a not dispensing state, a no-spill state, a traveling state, or a not in use state) and an open state (i.e., a dispensing state). When in its closed state, the straw mechanism prevents the contents of the beverage container from spilling out or otherwise being dispensed or consumed from the beverage container. When in its open state, the straw mechanism allows the contents of the beverage container to be consumed or otherwise dispensed from the beverage container.

The lid structure in accordance with aspects herein comprises a no touch straw mechanism and a body portion. The body portion has a threaded engagement section configured to securely engage the base structure of the beverage container, and a gear system for operating the spout portion to transition it from an open state and a closed state. The gear system is comprised of a plurality of gears. The primary gear located behind an engagement sleeve that comprises a plurality of teeth extending around a circumference of the body portion and is configured to be manipulated by a user by applying a rotational force in a clockwise or a counter-clockwise direction. The spout portion is also engaged with a second gear that engages the primary gear by one or more intermediary gears that translate the force applied to the primary gear to the second gear, causing the spout portion to transition from the closed state to the open state and vice versa.

The straw mechanism of the lid structure comprises a spout portion having a spout conduit extending from a first end to a second end of the spout. When the conduit is aligned with a straw opening of the lid structure, the lid structure is in an open state, and when the conduit is misaligned with the straw opening of the lid structure, the lid structure is in a closed state. The spout portion may be rigid and formed from, for example a hard polymer or plastic material, a metal, or the like. In a different example, the spout portion may be flexible (i.e., bendable, stretchable, elastic, deformable) and formed from a suitable material such as silicone or other rubber polymer material, by way of non-limiting example.

Aspects herein are generally further directed to a beverage container, the beverage container being comprised of a base structure and a lid structure having a no touch straw mechanism. The base structure may be comprised of a double wall plastic structure, or polymer based material structure, or a thermally insulating structure comprised of stainless steel, aluminum, copper, or any other suitable material or combination of materials suitable for insulating the contents of the beverage container from external temperature fluctuations for extended periods of time. The base structure in accordance with aspects herein includes an outer wall and an inner wall. The inner wall of the base structure includes a threaded portion proximal to the opening edge of the base structure. A step edge is provided in the inner wall of the base structure that defines the end of the threaded portion and the start of a non-threaded portion of the inner wall, where the non-threaded portion of the inner wall extends inward toward a relative center of the container further than the internal threaded section of the base structure. The inner wall of may optionally include volume markings configured to signal a volume quantity contained within the base structure as the base structure is filled with a beverage. The volume of the base structure may be sized and shaped to hold between 14 oz. and 100 oz. of a beverage. The beverage container may further have a friction sleeve covering at least 50% of the outer wall of the base structure. The friction sleeve may have a thickness "x" and a first portion of the outer wall configured to be covered by the friction sleeve may be offset by a distance x" so that a second portion of the outer wall not covered by the friction sleeve and the first portion covered by the friction sleeve are flush with one another once the friction sleeve is installed on the base structure. The friction sleeve may also serve to increase insulation properties of the base structure based on the type of material forming the friction sleeve. For example, the friction sleeve may be formed of a rubberized silicone, thermoplastic polyurethane rubber, polyurethane, or any other suitable material. Further, the friction sleeve, in addition to providing an improved grippable surface, it may also provide shock protection for the base structure, so that damage to the base structure is mitigated or minimize in the event of a fall of, strike to, or drop of the base structure.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

An overview of the features, functions and/or configurations of the components depicted in the various figures will now be presented. It should be appreciated that not all of the features of the components of the figures are necessarily described. Some of these non-discussed features, such as various couplers, etc., as well as discussed features are inherent from the figures themselves. Other non-discussed features may be inherent in component geometry and/or configuration.

DETAILED DESCRIPTION

The subject matter of embodiments of the present invention is described with specificity herein to meet statutory requirements. However, the description itself is not intended to limit the scope of this patent. Rather, the inventor(s) have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Figure 1:
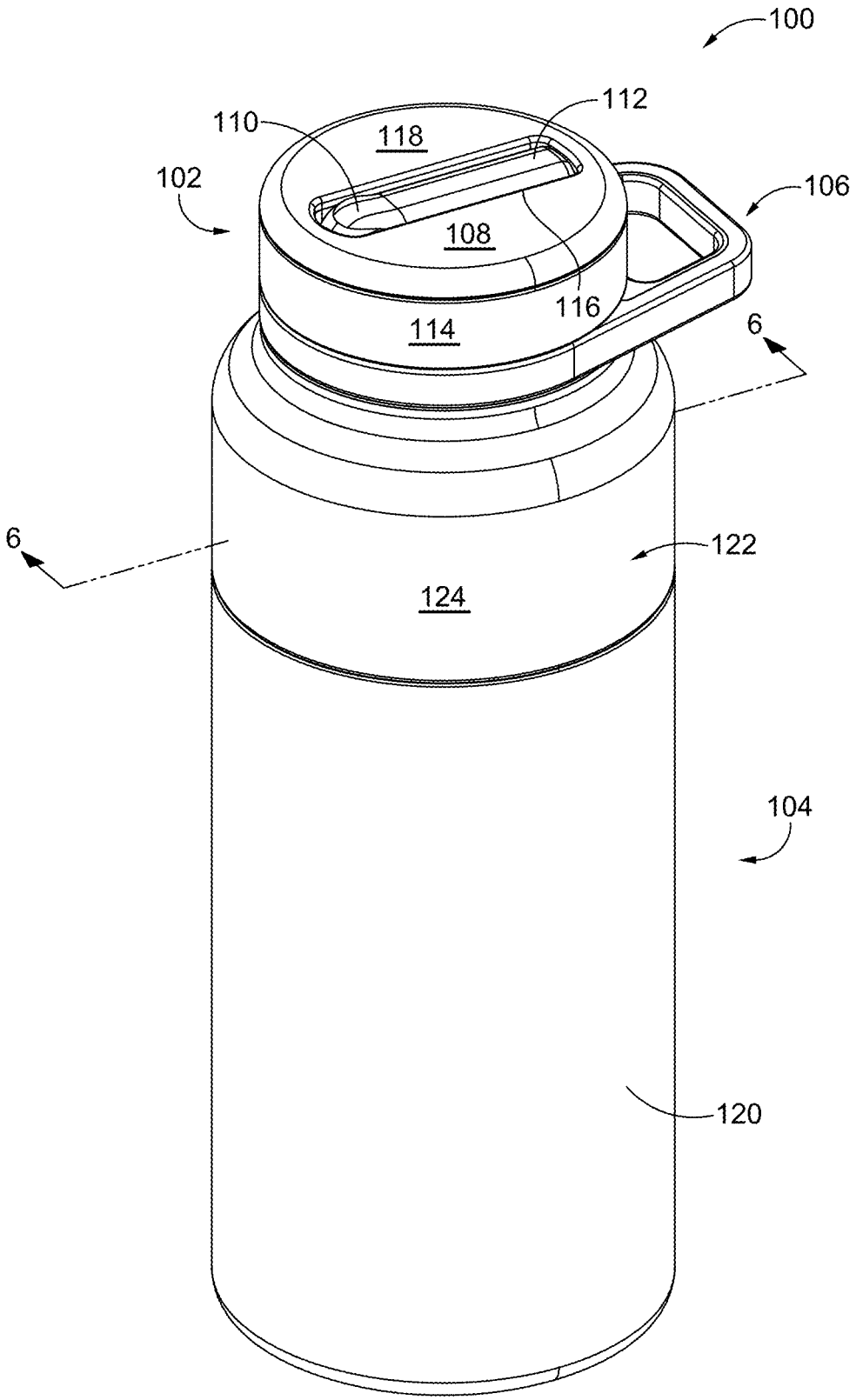
FIG. 1 depicts a perspective view of an assembled beverage system with a lid structure, in accordance with aspects herein.

At a high level, a beverage system 100 as shown in FIG. 1 is disclosed. The beverage system 100 comprises a lid structure 102 and a base structure 104 as the main components. The beverage system 100 may optionally further include a handle 106 to facilitate carrying of the beverage system 100. As further shown in FIG. 1, the lid structure 102 can have a body portion 108, a no touch straw mechanism 110 having a spout portion 112 with a spout opening 118 through which a user is able to drink fluids contained within the beverage system 100. The no touch straw mechanism 110 further includes a primary gear located behind an engagement sleeve 114. The spout portion 112 extends from a cavity 116 of the body portion 108 so that it extends through and above a first surface 118 (exterior surface) of the body portion 108. The engagement sleeve 114 is configured to be gripped by a user and turned clockwise or counter-clockwise to cause the spout portion 112 to be raised to allow a user to drink from it (open state), or stored within the cavity 116 of the body portion 108.

Figure 2:
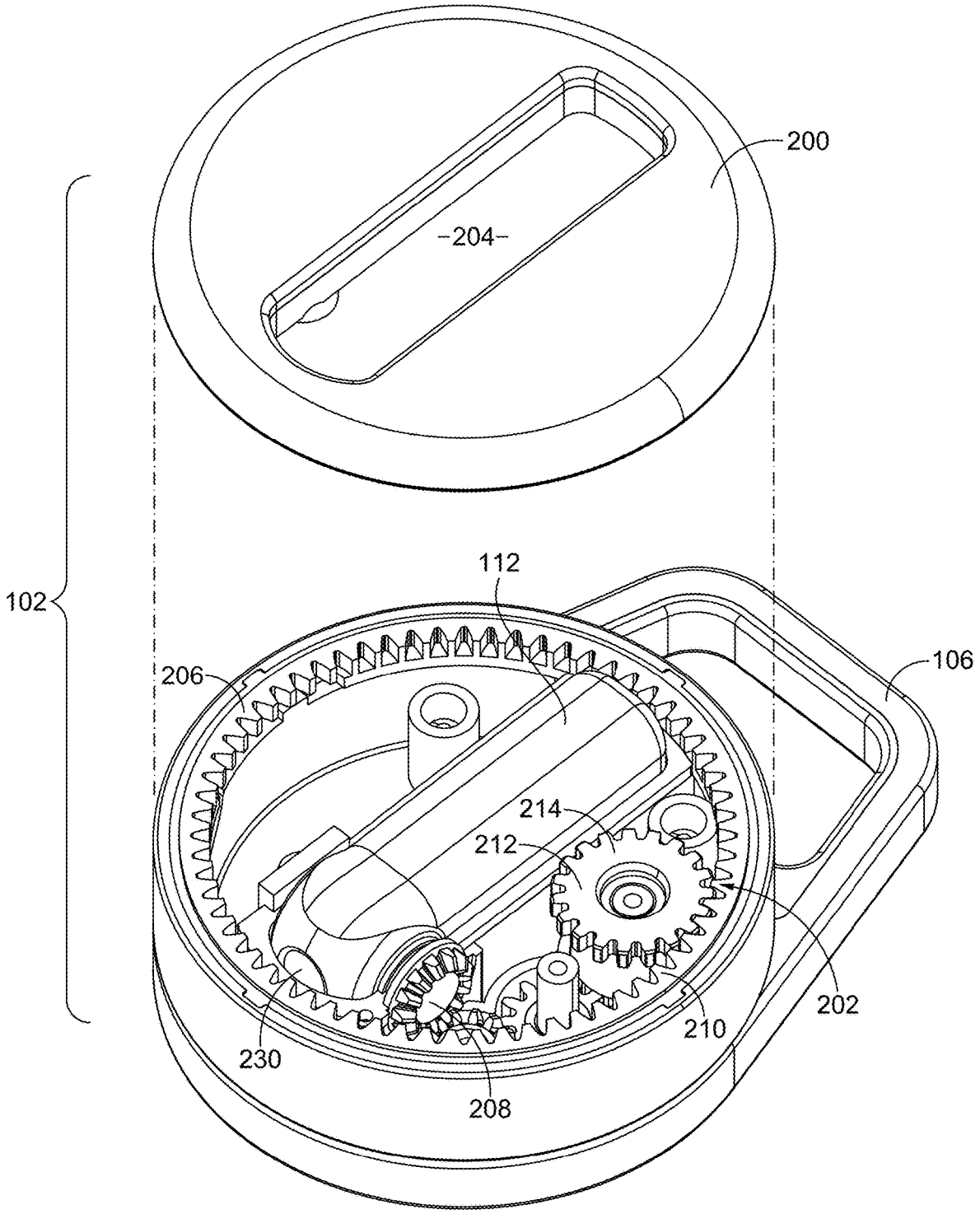
FIG. 2 depicts a perspective view of a partially deconstructed view of the lid structure of the beverage system shown in FIG. 1, in accordance with aspects herein.

As shown in FIG. 2, the body portion 108 comprises a cover 200 concealing the gear system 202 housed within the lid structure 102. The cover 200 comprises an opening 204 to allow for storage of the spout portion 112 and to allow the spout portion 112 to extend outward for use. The body portion 108 further comprises a vent structure 602 (shown in FIG. 6) underneath the spout portion 112 for allowing proper air circulation within the beverage system 100 as the contents are pulled from the base structure 104 when the user is drinking from the spout portion 112, thereby, insuring a proper flow or maintenance of a proper flow of the liquid through the spout portion 112. In other words, the vent structure 602 becomes uncovered or exposed to allow for its proper function.

Figure 3:
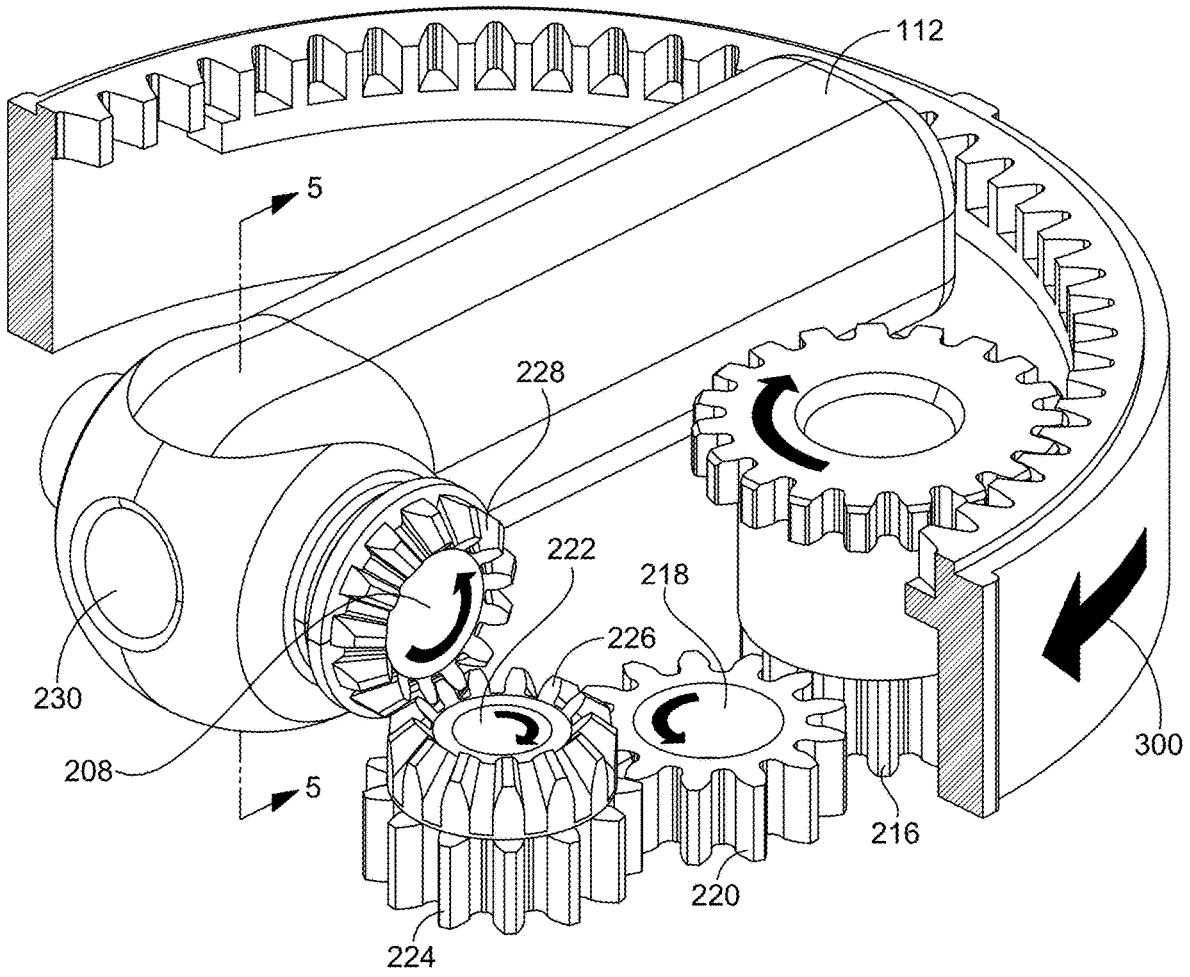
FIG. 3 depicts a perspective view of no touch straw mechanism of the lid structure of the beverage system shown in FIG. 2, in accordance with aspects herein.

The gear system 202 housed within the body portion 108, is comprised of a primary gear 206 and a secondary gear 208. The primary gear 206 and the secondary gear 208 are mechanically engaged to each other such that a force applied to the primary gear 206 translates into the spout portion 112 being manipulated to transition from a stored state to a raised state and vice versa. The gear system 202 may mechanically engage the primary gear 206 and the secondary gear 208 through one or more intermediary gears. For example, as shown in further detail in FIG. 3, the plurality of teeth 210 of the primary gear 206 may be engaged with a first plurality of teeth 214 of a first intermediary gear 212. The first intermediary gear 212 may further comprise a second plurality of teeth 216, which may engage with a plurality of teeth 220 of a second intermediary gear 218. The plurality of teeth 220 of the first intermediary gear 218 may further engage a first plurality of teeth 224 of a secondary intermediary gear 222. The secondary intermediary gear 222 may further include a second plurality of angled teeth 226 that are configured to engage a plurality of angled teeth 228 of the secondary gear 208. The second plurality of angled teeth 226 and the plurality of angled teeth 228 being angled to engage orthogonally to one another rather than in a side by side arrangement. As such, as shown in FIG. 3, when a force 300 is applied in a clockwise or counter clockwise direction, the force 300 rotates initiates movement of the gear system 202 so that the first intermediary gear 212 is set in motion to further set the secondary intermediary gear 222 in motion, and to further set the secondary gear 208 in motion, which in turn, causes the spout portion 112 to either be raised when rotated in a first direction, or stored when rotated in the opposite direction. As shown, the spout portion 112 comprises a spout conduit 230 configured to fluidly connect a straw of the beverage system 100 to the spout portion 112 when the spout portion 112 is raised, allowing fluids to flow from the straw through the spout portion 112.

As further shown in FIG. 1, the lid structure 102 of the beverage system 100 may optionally include a handle 106 to facilitate transport of the beverage system 100 by a user. Furthermore, the beverage system 100 may further include a friction sleeve 120 configured to cover at least 50% of an outer wall 122 of the base structure 104 to aid in keeping the beverage system 100 from sliding across a flat surface such as a counter, a table, and the like. Further, the friction sleeve 120 also provides an improved grippable surface that is non-slip to a user. The friction sleeve may have a thickness "x" and a first portion of the outer wall 122 of the base structure 104 configured to be covered by the friction sleeve 120 may be offset by a distance x' from a second portion 124 of the outer wall 122 not covered by the friction sleeve 120. This allows for the second portion 124 and the first portion covered by the friction sleeve 120 to be flush with one another once the friction sleeve is installed on the base structure 104. The friction sleeve 120 may also serve to increase insulation properties of the base structure 104 based on the type of material forming the friction sleeve 120. For example, the friction sleeve may be formed of a rubberized silicone, thermoplastic polyurethane rubber, polyurethane, or any other suitable material. Further, the friction sleeve 120, in addition to providing an improved grippable surface, it may also provide shock protection for the base structure 104, so that damage to the base structure 104 is mitigated or minimize in the event of a fall, strike, or drop of the base structure 104.

Figure 4:
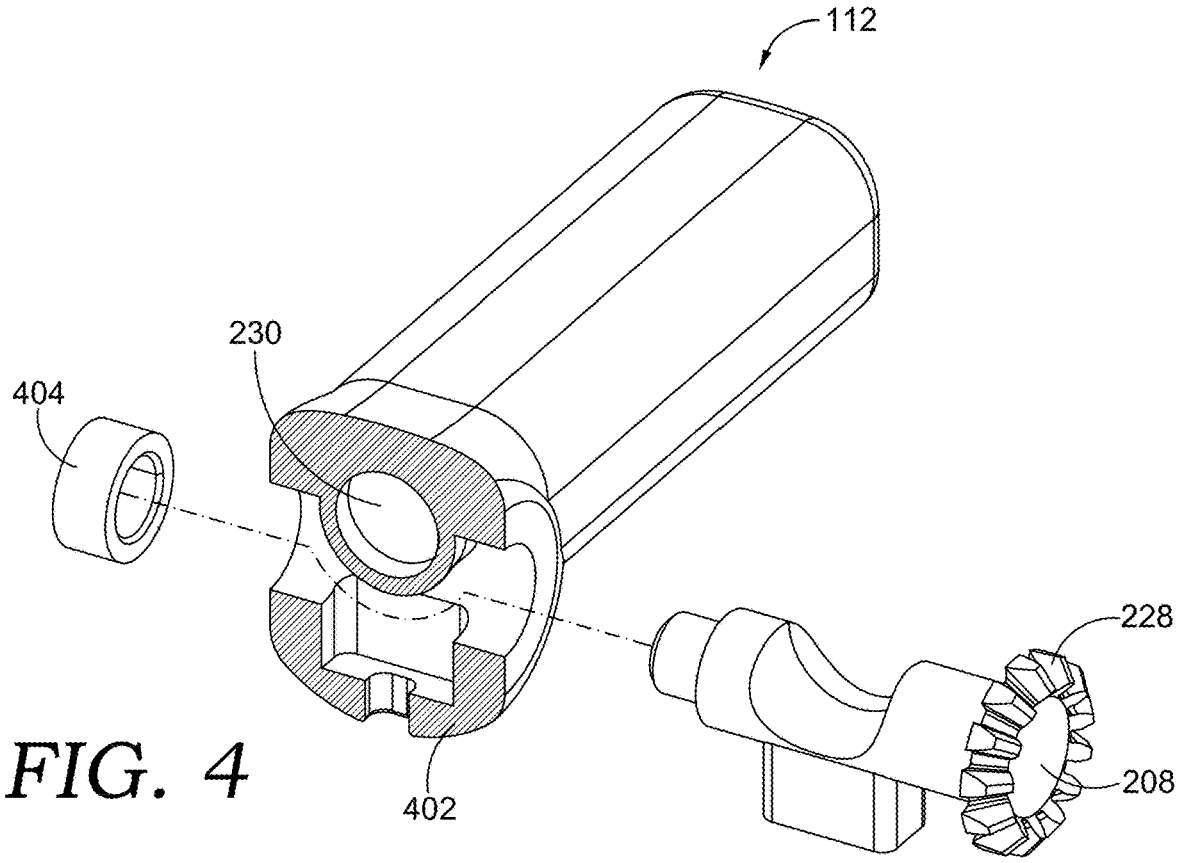
FIG. 4 depicts a perspective view of the spout portion shown in FIG. 3, in accordance with aspects herein.
Figure 5:
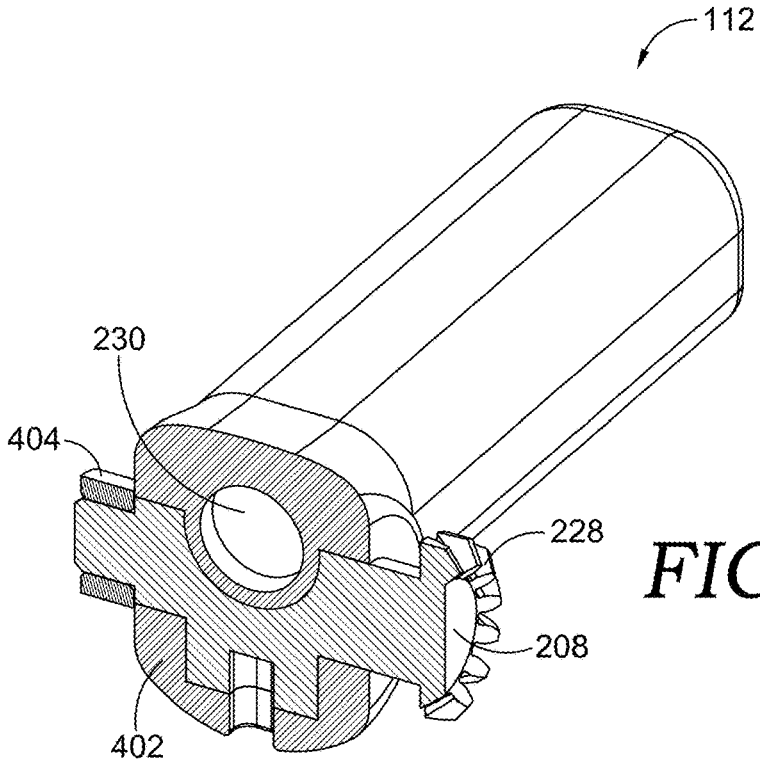
FIG. 5 depicts a perspective view of the spout portion of the no touch straw mechanism of the beverage system, in accordance with aspects herein.

FIG. 4 depicts a disassembled view of the spout portion 112. The secondary gear 208 and a spout body 400 of the spout portion 112 may be formed as a unitary piece, or, as shown in FIG. 4, the secondary gear 208 and the spout body 400 may be formed as separate pieces that may be molded together so that the secondary gear 208 is fitted within a secondary gear shaped cavity within a base portion 402 of the spout body 400. The base portion 402 of the spout body 400 and the secondary gear 208 are in, for example, a nut and bolt type of relationship, wherein the secondary gear 208 is secured to the base portion 402 at the other end of the plurality of angled teeth 228 by a gasket functioning as a nut 404. FIG. 4 shows a disassembled view of the spout body 400 and the secondary gear 208 and FIG. 5 shows an assembled view of the spout body 400 and the secondary gear 208.

Figure 6:
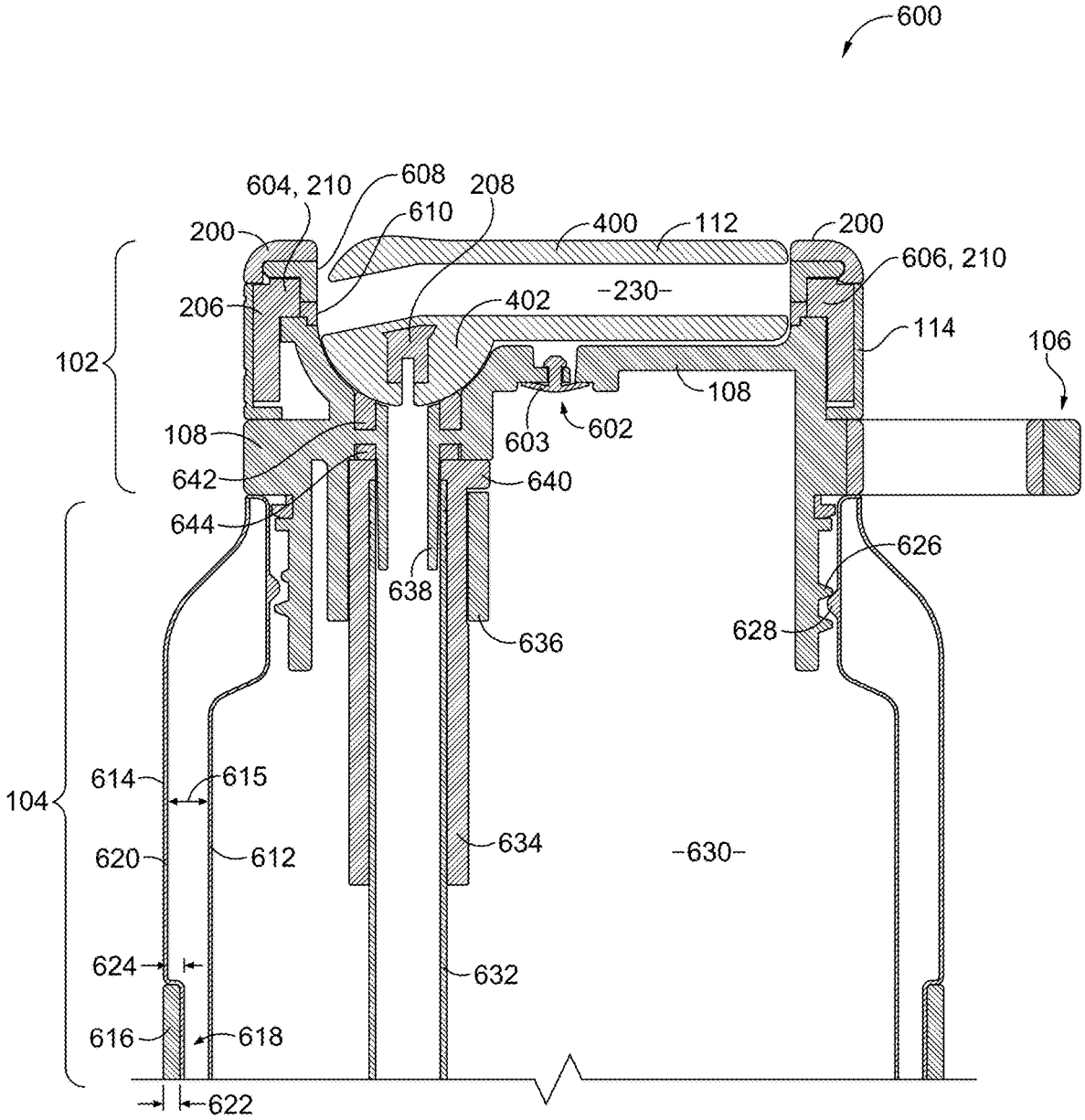
FIG. 6 depicts a cross-sectional view of the assembled beverage system depicted in FIG. 1 along the line 6-6 in FIG. 1.

FIG. 6 depicts a cross-section 600 of the beverage system 100 along the line 6-6 in FIG. 1. As shown in FIG. 6, the base portion 402 of the spout body 400 has a ball shape to facilitate its translation from an open state and a closed state in a ball and socket type of relationship. Further, the primary gear 206 extends around a circumference of the lid structure 102. As shown by tooth 604 and tooth 606 of the plurality of teeth 210, the gear system 202 is housed within the body portion 108 and capped and enclosed within the body portion 108 by at least the cover 200 of the lid structure 102. The cover 200 may further include cover pieces 608 and 610 to form walls of cavity 116 aligning with opening 204 of the cover 200, where the cavity 116 encloses the spout portion 112 within lid structure 102.

As further shown in FIG. 6, the volume of the base structure 104 may be sized and shaped to hold between 14 oz. and 100 oz. of a liquid beverage. The base structure 104 comprises an inner wall 612 and an outer wall 614. An inner diameter of the inner wall 612 is generally smaller than an outer diameter of the outer wall 614, thereby providing a thickness 615 to the base structure 104 between the inner wall 612 and the outer wall 614. The thickness 615 may aid in providing insulation properties to the base structure 104 to prevent rapid cooling, rapid warming and/or sweating when containing cold or iced liquid beverages. Further, in order to improve gripping and/or gripping comfort, the base structure 104 may optionally be equipped with a friction sleeve 616 having a thickness "x," labeled as 622. In order to accommodate the friction sleeve 616, the outer wall 614 may have a first portion 618 offset from a second portion 620 by a distance "x," labeled as 624, such that, when the friction sleeve 616 is on the first portion of the base structure 104, the outer surface of the friction sleeve 616 is flush with the second portion 620 of the outer wall 614. The friction sleeve 616 may cover at least 50% of the outer wall 614 of the base structure. The body portion 108 of the lid structure 102 further comprises threading 626 that secure the lid structure 102 to the base structure 104. The base structure comprises threading 628 on its inner wall 612 defining the interior volume 630 that is complementary to the threading 628. As shown, the base structure 104 has the interior volume 630 for containing a beverage within the base structure 104.

Figure 8A:
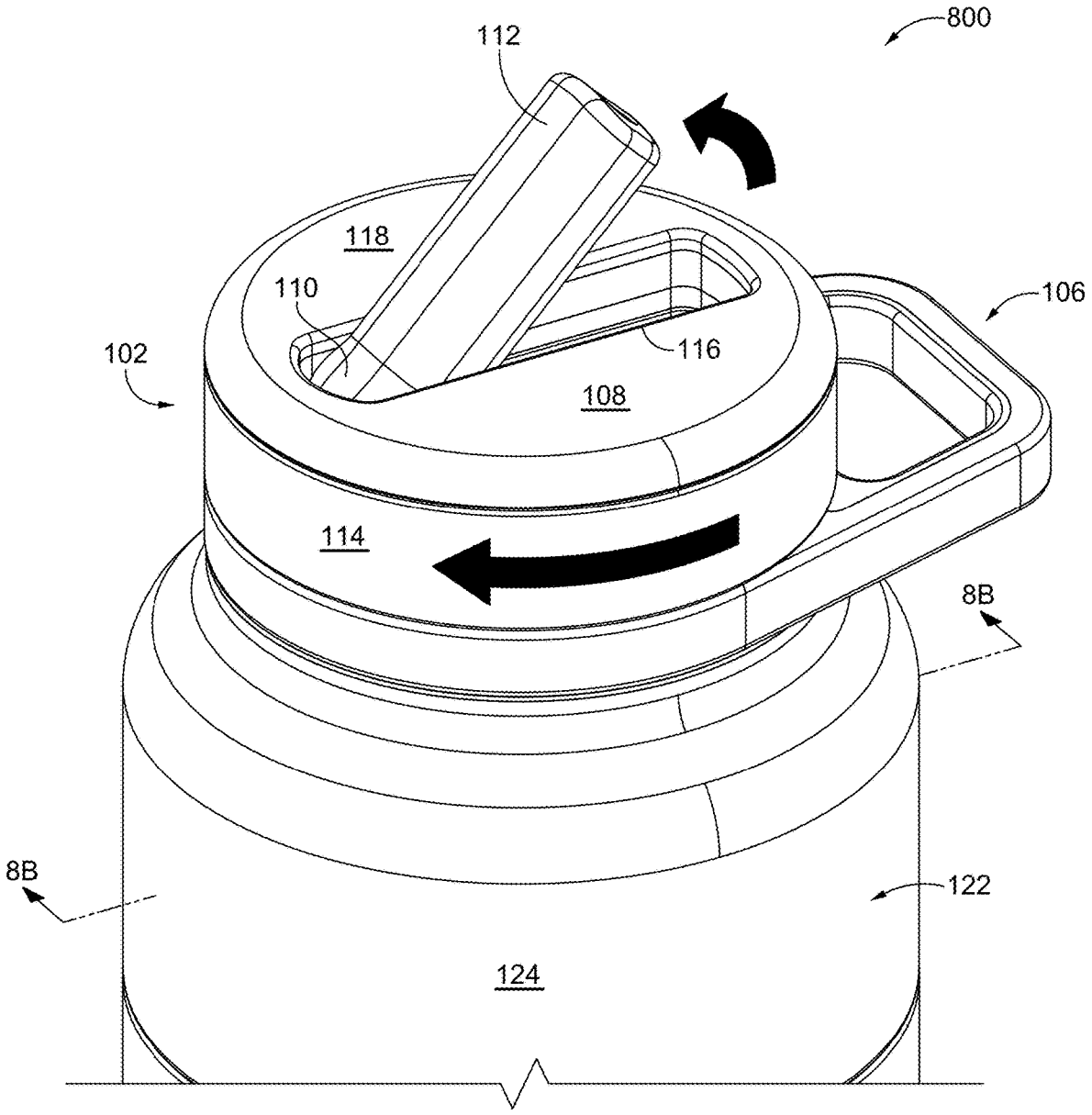
FIG. 8A depicts the assembled beverage system with the spout portion in an intermediary position.
Figure 8B:
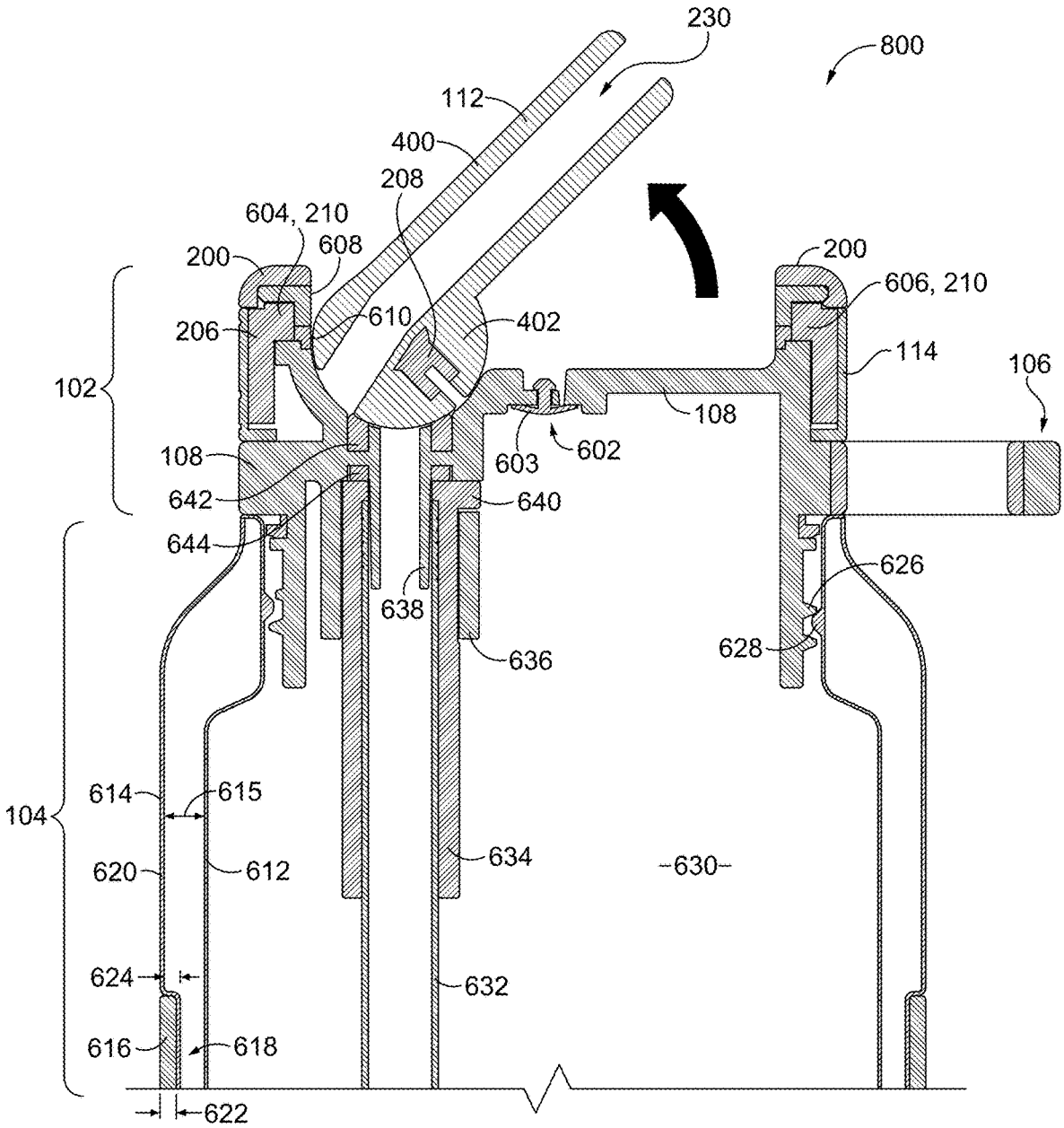
FIG. 8B depicts a cross-sectional view of the assembled beverage system depicted in FIG. 8A along the line 8B-8B in FIG. 8A.

FIG. 8A depicts the beverage system 100 where the spout portion 112 is in an intermediary position 800 as it is lifted up from cavity 116 when the engagement sleeve 114 is turned, for example, in a clockwise direction by force exerted by a user. As shown in the cross-sectional view in FIG. 8B, the spout conduit 230 is on its way to being aligned with the straw opening 708.

Figure 9A:
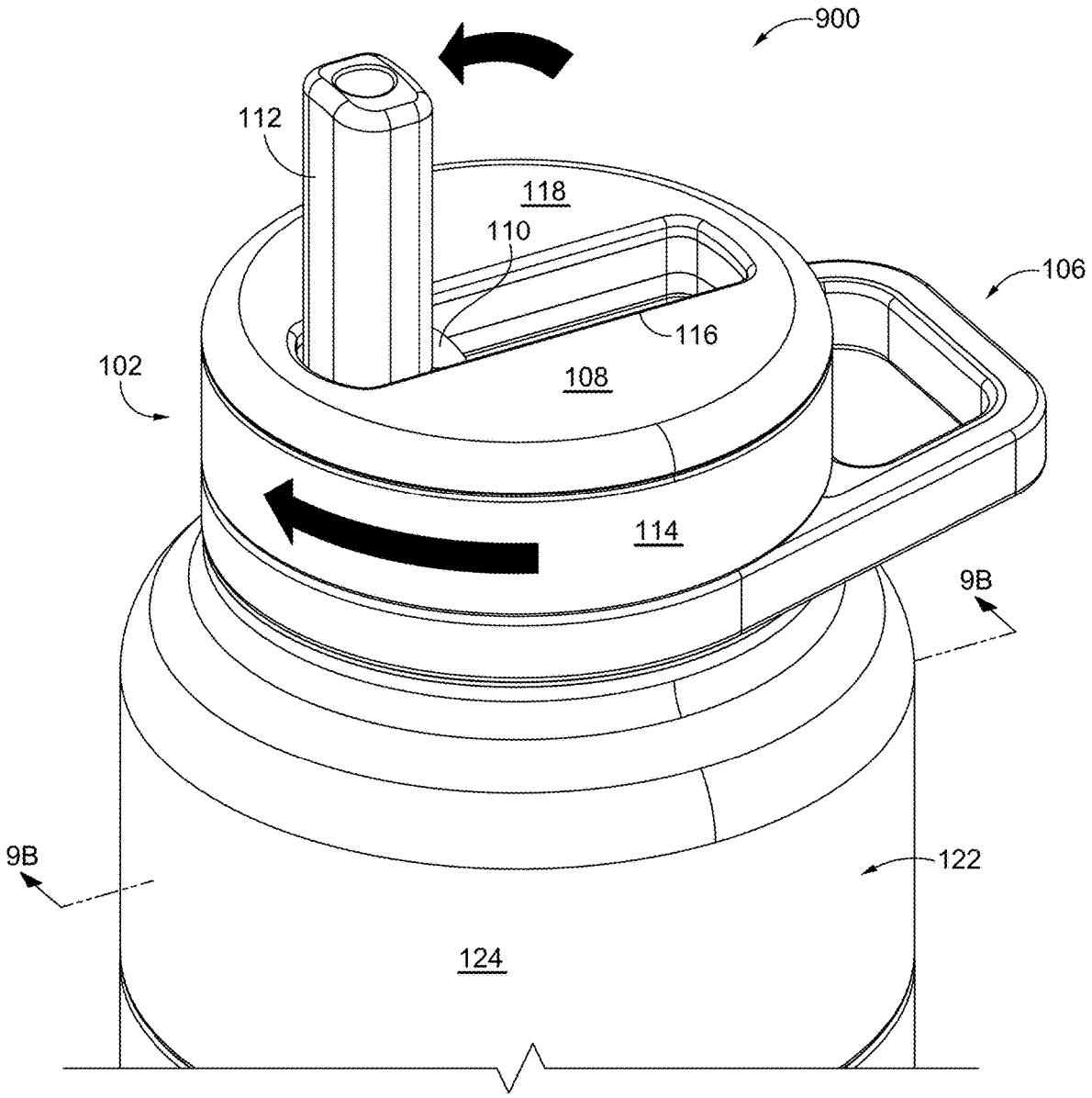
FIG. 9A depicts the assembled beverage system with the spout portion in a fully open position.
Figure 9B:
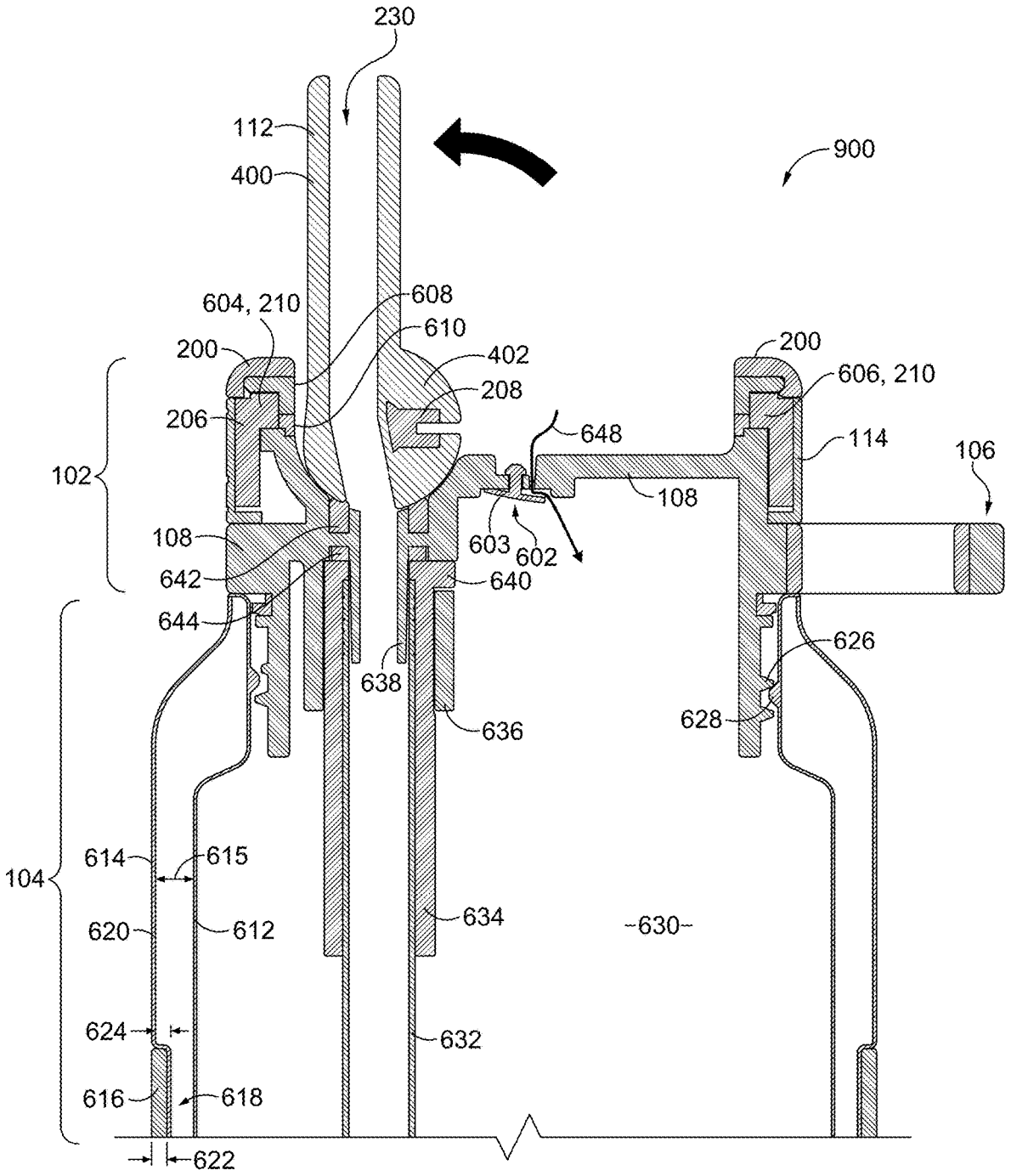
FIG. 9B depicts a cross-sectional view of the assembled beverage system depicted in FIG. 9A along the line 9B-9B in FIG. 9A when the vent structure is in a venting state.
Figure 9C:
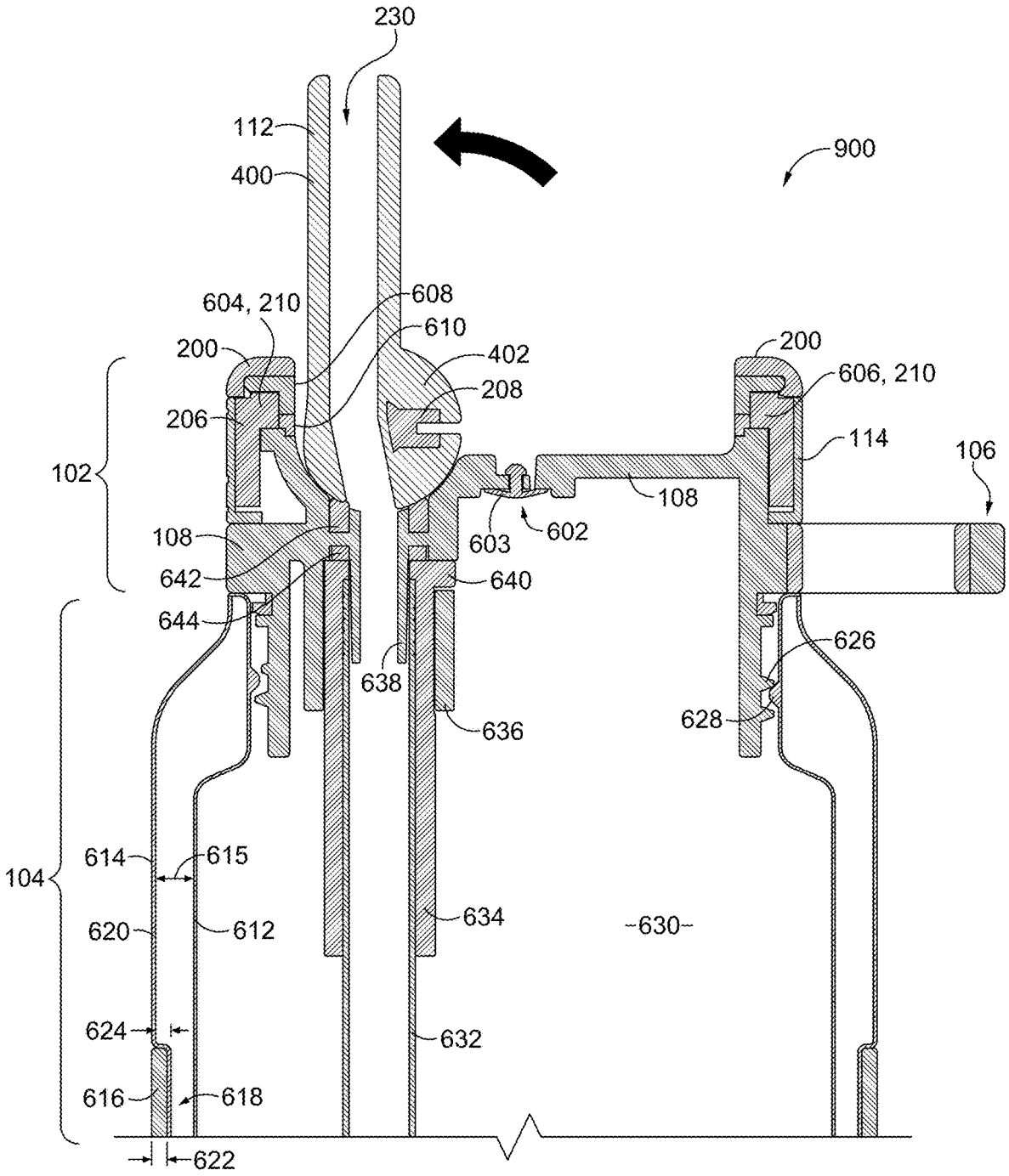
FIG. 9C depicts a cross-sectional view of the assembled beverage system depicted in FIG. 9A along the line 9B-9B in FIG. 9B when the vent structure is not in a venting state.

As further shown in FIG. 6, the vent structure 602 comprises a vent seal 603 made from a flexible rubber or silicone material. FIG. 9A depicts the beverage system 100 where the spout portion 112 is in a fully open position 900, and where the spout conduit and the straw opening 708 are in full alignment with one another, as shown in the cross-sectional view in FIGS. 9B and 9C. The fully connected spout conduit 230 and the straw opening 708 allow for contents within the interior volume 630 to freely flow through both the straw and through the spout portion 112. Although not shown, the spout portion 112 can be returned to its stored position within the cavity 116 by applying a force by the user in an opposite direction, for example, counterclockwise direction. The vent seal 603 is able to deform as a vacuum is created within the beverage system portion 112 and straw 632. Deformation of the vent seal 603, as shown in FIG. 9B, allows airflow 648 into the beverage system 100 to create an equilibrium between the interior volume 630 and the exterior environment. The equilibrium created allows the beverage contained within the interior volume 630 to flow as the user is actively consuming contents of the beverage system 100 through the spout portion 112. When the user is not actively consuming contents of the beverage system 100 through the spout portion 112, the vent seal 603 is returned to its original state, i.e., non-deformed state, as shown in FIG. 9C, even if the spout portion 112 is in its fully open position.

Figure 7A:
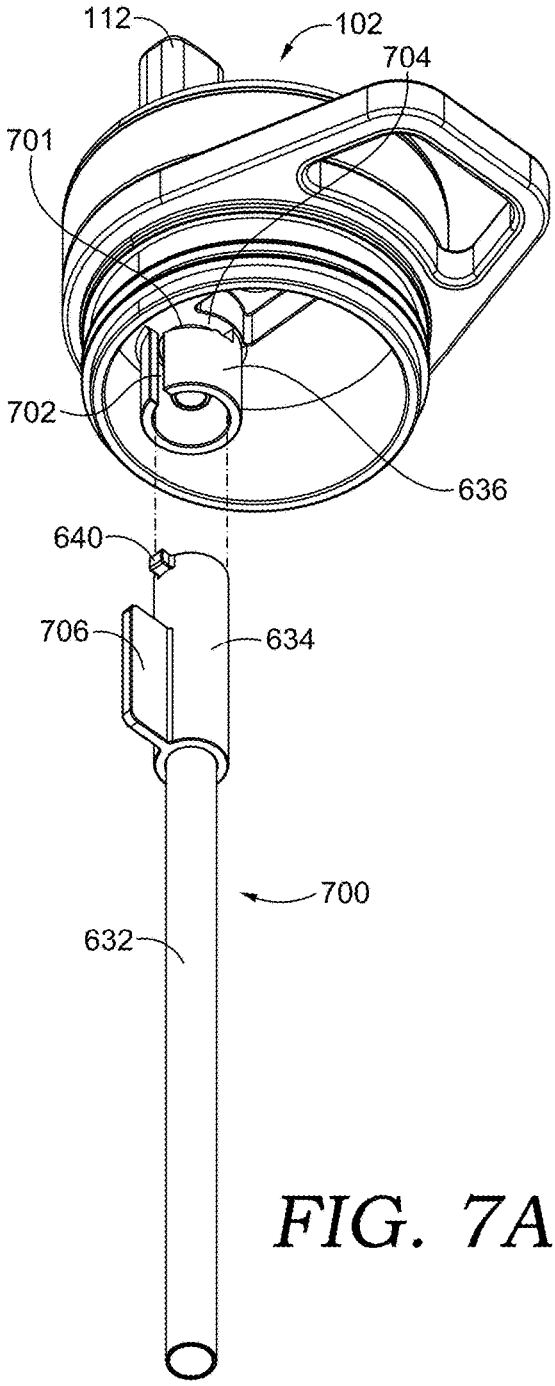
FIGS. 7A-7E depict a keyed straw assembly usable in accordance with aspects herein.
Figure 7B:
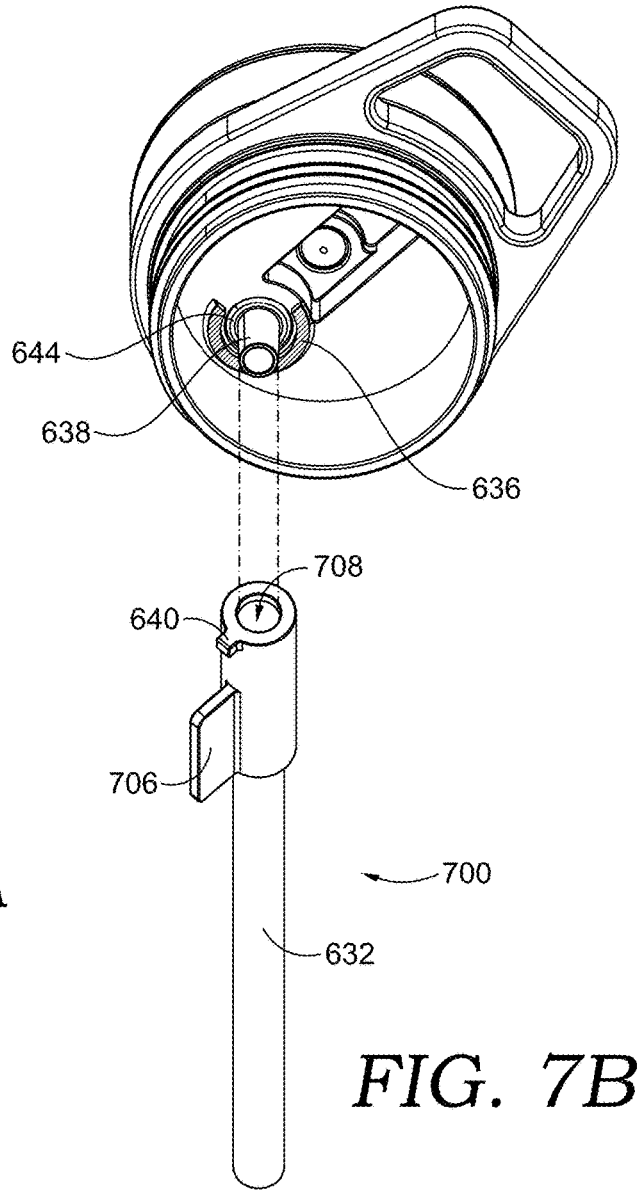

Returning back to FIG. 6, further shows a cross-sectional view of a keyed straw assembly 700 shown in FIG. 7A comprised of straw 632 equipped with a sleeve 634. The sleeve 634 is further equipped with a straw tab 640 configured to engage a connection port 636 of the lid structure 102. The lid structure 102 further comprises a straw fitting 638 configured to be fitted within an opening 708 of the straw 632 (as shown in FIG. 7B). The lid structure 102 is further equipped with gaskets 642 and 644 that seal the lid structure 102 to prevent contents within the base structure 104 from spilling when the beverage system 100 is closed and the lid structure 102 is in its closed configuration. The straw tab 640 is configured to slide through a guide 701 in the connection port 636. The guide 701 comprises a vertical portion 702 and a horizontal portion 704, wherein the vertical portion 702 guides the straw tab 640 close to the body portion 108 of the lid structure 102 and the horizontal portion 704 secures the straw 632 to the lid structure 102. In order to aid a user's grip of the keyed straw assembly 700, the sleeve 634 may further be equipped with a straw handle 706.

Figure 7C:
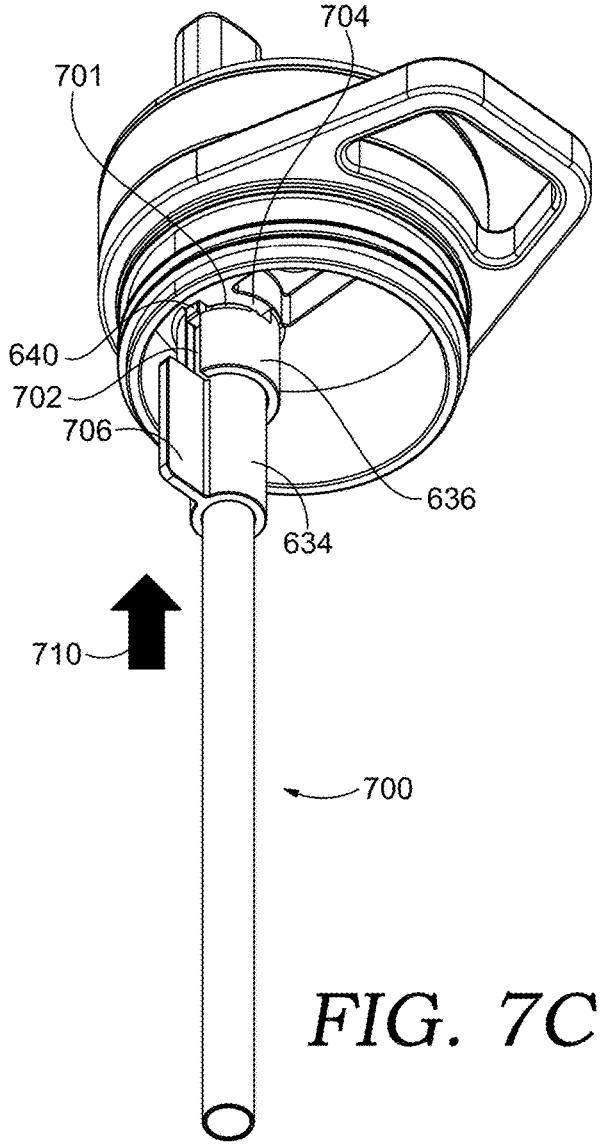
Figure 7D:
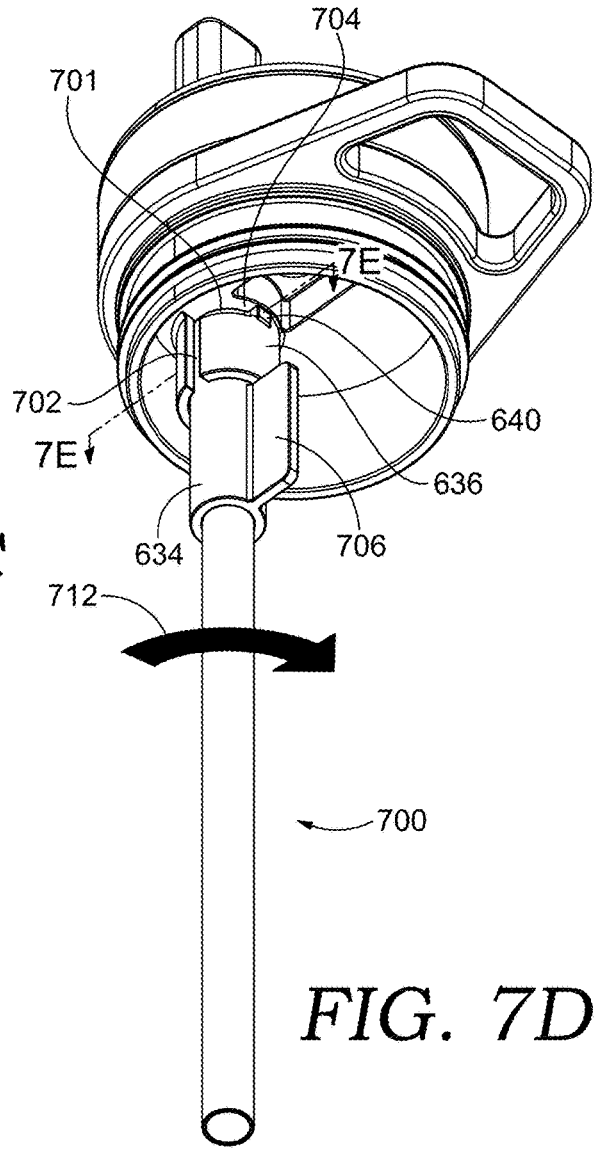
Figure 7E:
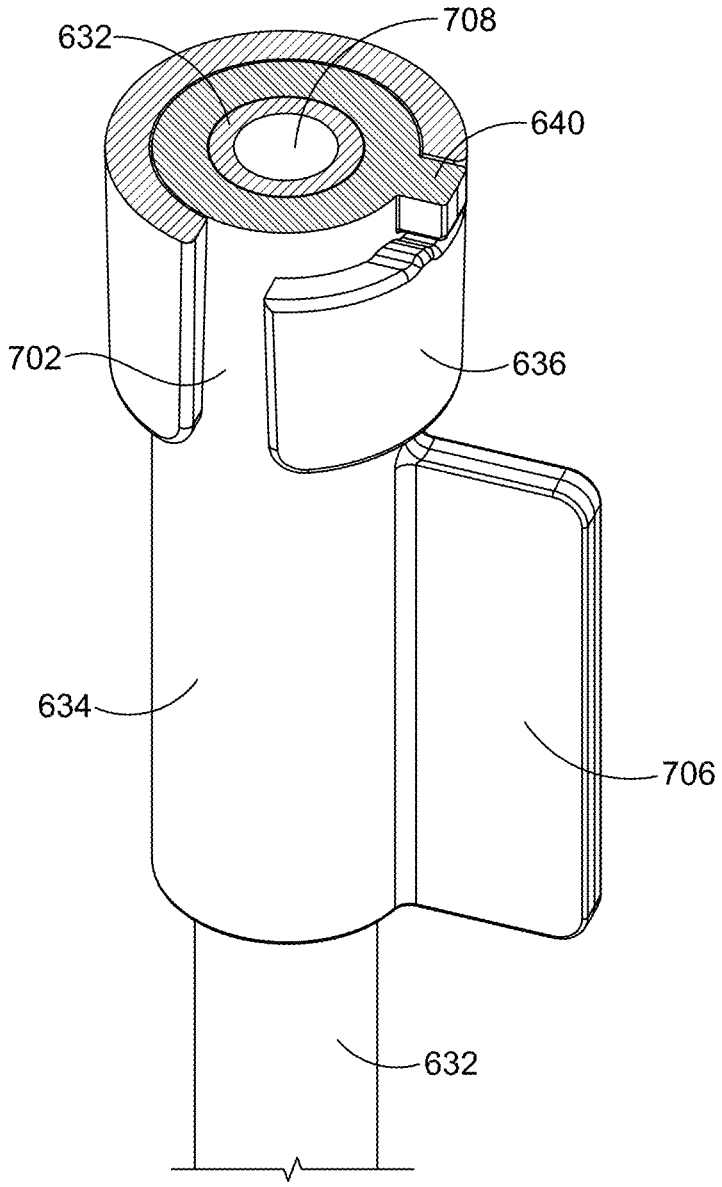

The straw 632 may be made from any suitable material that is safe for use and food grade such as, for example, stainless steel, glass, silicone, bisphenol A (BPA) free plastics, and the like. The straw handle 706 may be molded onto the straw 632, or may be made as one piece with the straw 632, or may be fitted onto straw 632. The straw handle 706 may be made from the same material as the straw 632, or a different material as the straw 632. The straw handle 706 may be removable from straw 632 or may be permanently affixed to straw 632. As shown in FIG. 7C, when assembling the keyed straw assembly 700 with the lid assembly 102, the keyed straw assembly 700 is first glided upwards in a vertical direction 710 through the vertical guide 702 of the straw connection portion 636. To facilitate the process, the straw handle 706 may be directly aligned with the straw tab 640. Once the keyed straw assembly 700 is within the connection portion 636, as shown in FIG. 7C, the keyed straw assembly 700 can be turned in a clockwise direction 712 gliding the straw tab 640 through the horizontal guide 704, thereby locking the keyed straw assembly 700 to the body portion 108. Again, this motion can be facilitated by the straw handle 706. FIG. 7E show a cross-sectional view along the line 7E-7E in FIG. 7D.

Figure 10A:
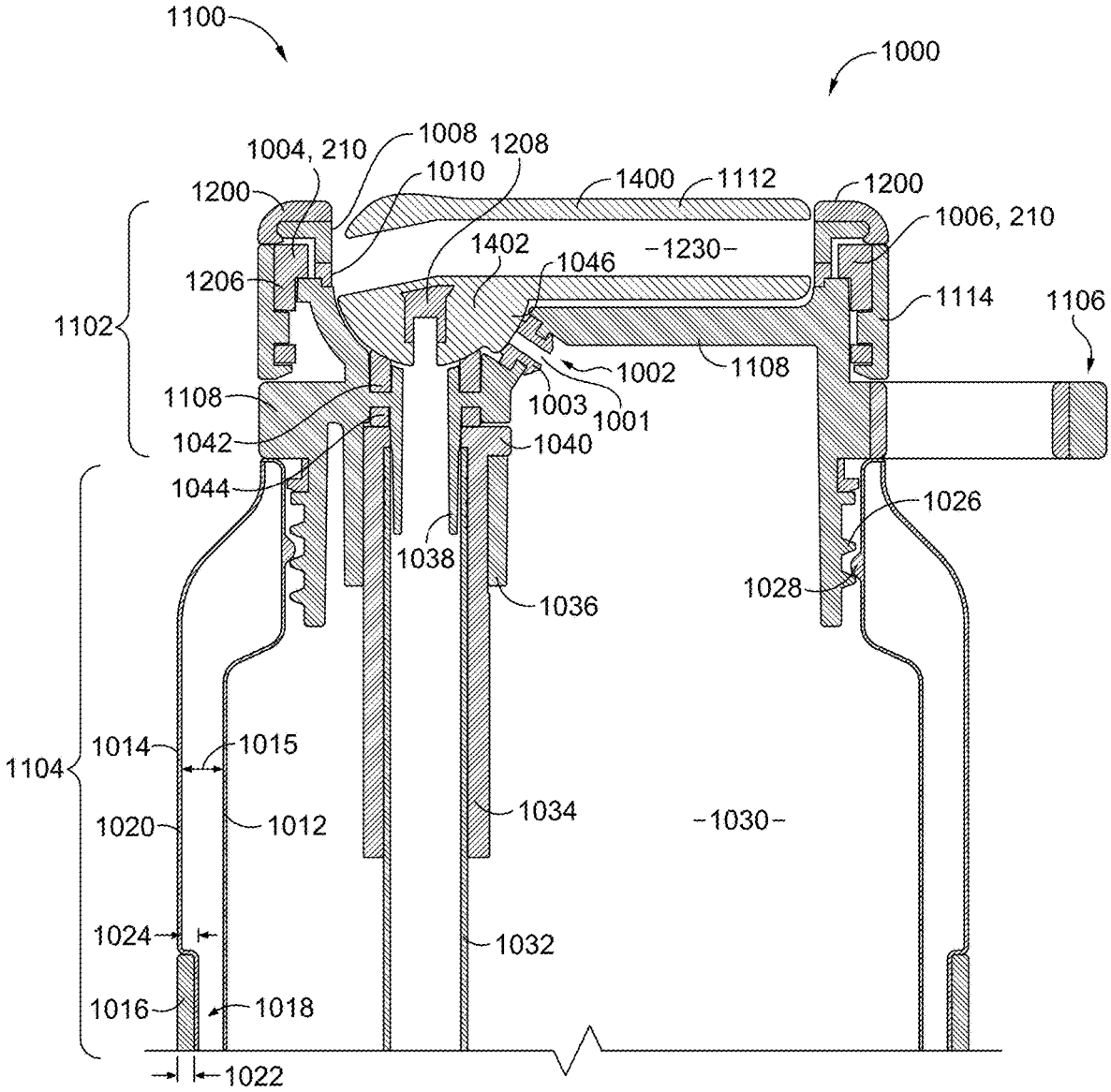
FIG. 10A depicts a cross-sectional view of another assembled beverage system similar to the one shown in FIG. 1.

FIG. 10A depicts a cross-section 1000 of a beverage system 1100 that is similar to the beverage system 100 shown in FIG. 1. However, the beverage system 1100 comprises a different venting mechanism from the one shown in FIGS. 6, 8B, 9B and 9C. As shown in FIG. 10A, the beverage system 1100 has a lid structure 1102 and the base structure 1104 that operate similar to the beverage system 100. For example, the base structure 1104 may have a thickness 1015 between an inner wall 1012 and an outer wall 1014. The base structure 1104 may also have a first portion 1018 where the outer wall 1014 is offset from a second portion 1020 by a distance 1024 to accommodate a friction sleeve 1016 having a thickness "x" labeled as 1022, where distance 1024 can be the same as the thickness "x" of the friction sleeve 1016. The base portion 1104 may further comprise threading 1028 configured to work with threading 1026 of the body portion 1108 of the lid structure 1102 to secure the lid structure 1102 to the base structure 1104. Like the beverage system 100 shown in FIG. 6, the interior volume 1030 of the base structure 1104 may be sized and shaped to hold between 14 oz. and 100 oz. of a liquid beverage.

Moving on to the lid structure 1102, similar to the lid structure 102, may have a handle 1106 and a spout portion 1112 having a spout body 1400, a spout conduit 1230, and a base portion 1402. However, the lid structure 1102 is configured to vent itself even when a user is not consuming contents of the beverage system 1100, for example when exposed to changes in atmospheric pressure. In the lid structure 1102, the vent structure 1002 may be positioned at an angle from an orthogonal plane to the plane cutting the beverage system 1100 to provide the cross-section 1000 (i.e., a plane parallel to a bottom base (not shown) of the base structure 1104). Further, the vent structure 1002 may comprise a vent stopper 1003 formed from a flexible rubber or silicone material having an opening through it. Like the beverage system 100, the base portion 1402 of the spout body 1400 may have a ball shape to facilitate its translation from an open state and a closed state in a ball and socket type of relationship. The base portion 1402 of the spout body 1400, however, comprises a protrusion 1046 that is configured to align with the vent stopper 1003, thereby applying pressure to the vent stopper 1003 and thereby blocking the opening 1001 of the vent stopper 1003 when the straw mechanism of the beverage system 1100 is in the closed state.

Further, the primary gear 1206, like the primary gear 206 of the beverage system 100, may extend around a circumference of the lid structure 1102. As shown by tooth 1004 and tooth 1006 of the plurality of teeth 210 shown in relationship to beverage system 100, the gear system is housed within the body portion 1108 and capped and enclosed within the body portion 1108 by at least the cover 1200 of the lid structure 1102. Like the cover 200, the cover 1200 may further include cover pieces 1008 and 1010 to form walls of the cavity aligning with the opening of the cover 1200 for allowing the spout portion 1112 to extend through it like shown in FIG. 2, where the cavity 116 encloses the spout portion 112 (or 1112) within lid structure 102 (or 1102).

Additionally, like beverage system 100 having the gear system 202 housed within the body portion 108, the beverage system 1100 also comprises a gear system having a secondary gear 1208 is within the base portion 1402 to engage with a primary gear configured to, like the beverage system 100, mechanically engage a primary gear to open and close the beverage system 1100 without touching the spout portion 1112, by engagement of the engagement sleeve 1114 by a user using a clockwise or counterclockwise motion. Further, the beverage system 1100 may be equipped with a straw assembly 700 shown in FIG. 7A comprised of straw 1032 equipped with a sleeve 1034. The sleeve 1034 is further equipped with a straw tab 1040 configured to engage a connection port 1036 of the lid structure 1102. The lid structure 1102 further comprises a straw fitting 1038 configured to be fitted within an opening 708 of the straw 1032 (as shown in FIG. 7B). The lid structure 1102 is further equipped with gaskets 1042 and 1044 that seal the lid structure 1102 to prevent contents within the base structure 1104 from spilling when the beverage system 1100 is closed and the lid structure 1102 is in its closed configuration.

Figure 10B:
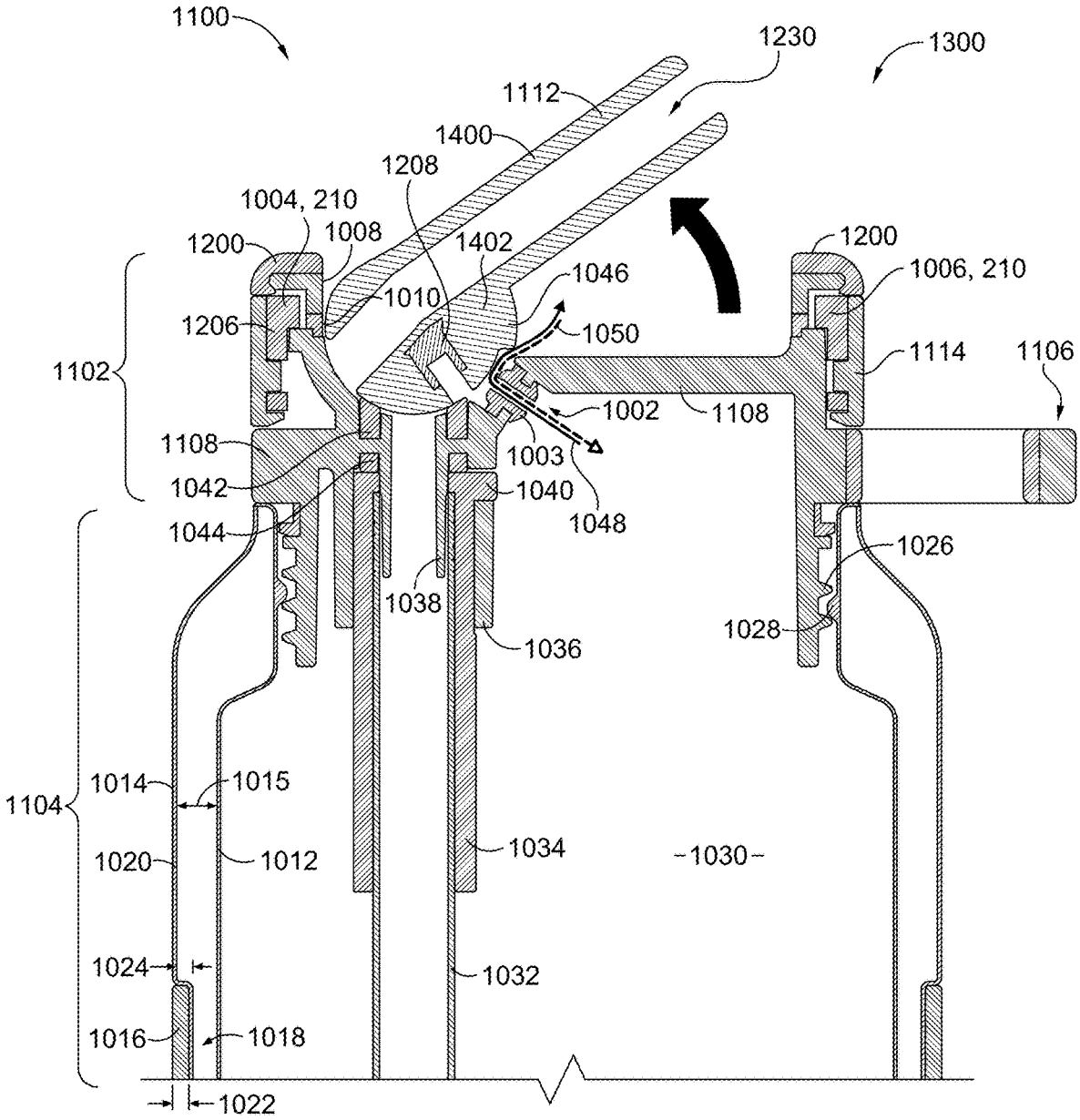
FIG. 10B depicts a cross-sectional view of an intermediary position of the spout of the assembled beverage system shown in FIG. 10A.

FIG. 10B depicts a cross-section 1300 of beverage system 1100, where the spout portion 1112 is in an intermediary position. As shown in FIG. 10B, when the spout body 1400 of the spout portion 1112 is lifted at least 30° from its initial position in the closed state shown in FIG. 10A, or when the protrusion 1046 is moved away from the vent stopper 1003, such that the opening 1001 of the vent stopper 1003 becomes uncovered. The uncovering of the opening 1001 of the vent stopper 1003 allows an airflow path to be created between an exterior environment and the interior volume 1030 of the beverage system 1100. This allows for the beverage system 1100 to vent itself prior to the spout conduit 1230 becoming fully aligned with the straw 1032. This is helpful in situations where pressure differentials between the interior volume 1030 and an external environment are created due to, for example, changes in altitude, changes in temperature, and the like. For example, in a situation where the interior volume 1030 of the beverage system becomes pressurized due to high altitude (i.e., low external environmental pressure) or a high external environmental temperature, air is allowed to flow out of the interior volume 1030, as shown by arrow 1048. Similarly, if the interior volume 1030 becomes depressurized, due to, for example, emptying of the contents of the beverage system 1100 through the straw mechanism, or due to a drop in the external environmental temperature, air is allowed to flow into the interior volume 1030, as shown by arrow 1050.

Additionally, although some exemplary implementations of the embodiments described herein are shown in the accompanying figures, these implementations are not intended to be limiting. Rather, it should be understood that the various embodiments and aspects described herein may be implemented upon any insulated container.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed:

1. A beverage system comprising:

a base structure comprising a threaded portion proximate an opening edge of the base structure;

a straw; and a lid structure comprising:

a no touch straw mechanism configured to reversibly mechanically transition from a first position where a spout conduit of a spout portion of the no touch straw mechanism is misaligned and orthogonal with a straw conduit of the straw, and a second position where the spout conduit of the spout portion is aligned with the straw conduit.

2. The beverage system of claim 1, wherein the no touch straw mechanism comprises the spout portion configured to reversibly mechanically transition from a first position and a second position.

3. The beverage system of claim 2, wherein the spout portion is mechanically engaged with a first gear of a gear system.

4. The beverage system of claim 3, wherein the gear system further comprises a second gear that is mechanically engaged with a body portion of the lid structure.

5. The beverage system of claim 4, wherein the gear system comprises at least one intermediate gear configured to mechanically engage with the first gear and the second gear.

6. The beverage system of claim 4, wherein a rotational force applied to the body portion translates the spout portion from the first position to the second position, wherein in the first position, the spout portion is stored within the body portion, and wherein in the second position, the spout portion is in a dispensing state.

7. The beverage system of claim 1, wherein the base structure comprises a double wall.

8. The beverage system of claim 1, wherein the base structure is insulated.

9. A lid structure comprising:

a no touch straw mechanism comprising a spout portion, where the spout portion is configured to reversibly and mechanically transition from a first position where a spout conduit of the spout portion is misaligned and orthogonal to a straw conduit of a straw connected to the lid structure, and a second position where the spout conduit of the spout portion is aligned with the straw conduit of the straw; and a body portion that is mechanically engaged to the no touch straw mechanism.

10. The lid structure of claim 9, further comprising an engagement sleeve rotatable relative to the body portion mechanically engaged to a body gear of the body portion.

11. The lid structure of claim 10, wherein the spout portion comprises a spout gear mechanically engaging the body gear and the engagement sleeve.

12. The lid structure of claim 11, further comprising an intermediary gear mechanically engaging the body gear and the spout gear.

13. The lid structure of claim 9, wherein when the spout portion is in the first position, the spout portion is stored within the body portion of the lid structure.

14. The lid structure of claim 9, wherein when the spout portion is in the second position, the spout portion is in a dispensing state.

15. The lid structure of claim 10, where rotation of the engagement sleeve about a first axis drives the body gear to translate the spout portion along a second axis that is substantially orthogonal to the first axis.

16. The lid structure of claim 10, where a rotational force applied to the engagement sleeve translates the spout portion from the first position to the second position, wherein in the first position, the spout portion is stored within the body portion, and wherein in the second position, the spout portion is in a dispensing state.

17. The lid structure of claim 16, where in the first position, the spout portion is stored within a cavity of the body portion.

18. The lid structure of claim 9, further comprising a vent structure in the body portion.

19. The lid structure of claim 9, where the body portion and the no touch straw mechanism have a ball and socket type of relationship, a base portion of the spout portion having a ball shape.

20. A lid structure comprising:

a body portion;

a spout portion moveable between a stored position within the body portion and a dispensing position extending outwardly from the body portion;

an engagement sleeve rotatable relative to the body portion; and a gear train mechanically coupling the engagement sleeve to the spout portion, the gear train including a primary gear, at least one intermediary gear, and a secondary gear coupled to the spout portion, where rotation of the engagement sleeve about a first axis drives the gear train to translate the spout portion along a second axis substantially orthogonal to the first axis from the stored position to the dispensing position, where the spout portion provides a fluid pathway between a spout conduit of the spout portion and a straw conduit of a straw when in the dispensing position.

* * * * *